US009535353B2

(12) United States Patent
Srinivasan et al.

(10) Patent No.: US 9,535,353 B2
(45) **Date of Patent: *Jan. 3, 2017**

(54) FORMULATION FOR A DEVELOPER MIX HAVING TRIBOCHARGE UNIFORMITY ACROSS DIFFERENT TEMPERATURE AND HUMIDITY CONDITIONS

(71) Applicant: Lexmark International, Inc., Lexington, KY (US)

(72) Inventors: Kasturi Rangan Srinivasan, Longmont, CO (US); Ligia Aura Bejat, Lexington, KY (US); Michael Anthony Blassingame, Milliken, CO (US); Rick Owen Jones, Berthoud, CO (US); Brandon Michael Lin, Houston, TX (US); James Craig Minor, Niwot, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/580,852

(22) Filed: Dec. 23, 2014

(65) Prior Publication Data

US 2016/0179026 A1 Jun. 23, 2016

(51) Int. Cl.
*G03G 9/00* (2006.01)
*G03G 9/113* (2006.01)

(52) U.S. Cl.
CPC ..... *G03G 9/1139* (2013.01); *G03G 9/1132* (2013.01); *G03G 9/1135* (2013.01); *G03G 9/1136* (2013.01)

(58) Field of Classification Search
CPC ... G03G 9/1132; G03G 9/1135; G03G 9/1136; G03G 9/1139
USPC ..... 430/111.31, 111.32, 111.35
See application file for complete search history.

(56) References Cited

U.S. PATENT DOCUMENTS 6,042,982 A * 3/2000 Hakata ..... G03G 9/107 430/111.35
9,217,939 B2 * 12/2015 Srinivasan ..... G03G 9/0802
2014/0356782 A1 * 12/2014 Sugahara ..... G03G 9/083 430/111.35

* cited by examiner

*Primary Examiner* — Mark A Chapman

(57) ABSTRACT

A developer mix formulation having tribocharge uniformity across varying temperature and humidity conditions is provided. A developer mix used in a dual component development (DCD) system is a mixture of toner particles and magnetic carrier particles. Tribocharge uniformity is achieved in the developer mix by using magnetic carrier particles having surface additives on its surface. Surface additives include but are not limited to silica, titania and alumina.

10 Claims, No Drawings

FORMULATION FOR A DEVELOPER MIX HAVING TRIBOCHARGE UNIFORMITY ACROSS DIFFERENT TEMPERATURE AND HUMIDITY CONDITIONS

CROSS REFERENCES TO RELATED APPLICATIONS

This patent application is related to United States patent application Ser. No. 14/580,830, filed Dec. 23, 2014, entitled "Formulation for a Developer Mix Having Tribocharge Uniformity Across Different Temperature and Humidity Conditions", which is assigned to the assignee of the present application.

STATEMENT REGARDING FEDERALLY SPONSORED RESEARCH OR DEVELOPMENT

None

BACKGROUND

1. Field of the Invention

The present disclosure is directed at a formulation for a developer mix having tribocharge uniformity across different temperature and humidity conditions. This developer mix having tribocharge uniformity includes a magnetic carrier particle having surface additives on its surface.

2. Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

There are several known types of CPT including suspension polymerization toner, emulsion aggregation toner, latex aggregation toner, toner made from a dispersion of preformed polymer in solvent and chemically milled toner. While emulsion aggregation toner requires a more complex process than other CPTs, the resulting toner has a relatively narrower size distribution. Emulsion aggregation toners can also be manufactured with a smaller particle size allowing improved print resolution. The emulsion aggregation process also permits better control of the shape and structure of the toner particles which then allows the toner particles to be tailored to fit the desired cleaning, doctoring and transfer properties. The shape of the toner particles produced from an emulsion aggregation process may be optimized to ensure proper and efficient cleaning of the toner from various electrophotographic printer components, such as the developer roller, charge roller and doctoring blades, in order to prevent filming or unwanted deposition of toner on these components.

Toner may be utilized in image forming devices, such as printers, copiers and fax machines, to form images on a sheet of media. The image forming apparatus transfers the toner from a reservoir to the media via a developer system utilizing differential charges generated between the toner particles and the various components in the developer system. Electrophotographic printing can be carried out using a monocomponent development (MCD) system that requires the use of a toner adder roll, developer roll, and doctor blade for charging and doctoring the toner. Alternatively, the electrophotographic printing can be carried out using a dual component development (DCD) system which requires the use of a magnetic carrier particle and a magnetic roll to help charge the toner. Using a DCD system has the advantage of using fewer components and allowing for longer life cartridges and hence, a lower cost per page. Regardless of whether the toner is charged using a MCD or a DCD process, the printing of toner uses the same process of toner transfer to an imaging substrate that has been discharged via light, such as a photoconductor or photoreceptor drum or belt. Toner is then directly transferred to a media sheet or to an intermediate image transfer member before being transferred onto a media sheet.

In DCD printing, a mixture of toner particles and magnetic carrier particles is referred to as a developer mix. Mixing magnetic carrier particles with the surface-treated toner particles in the presence of some electrical voltage generates a triboelectric charge. It is desirable to have the developer mix maintain a uniform triboelectric charge across varying temperature and humidity conditions, including hot/wet (78° F./80% relative humidity), cold/dry (60° F./8% relative humidity) and ambient (72° F./40% relative humidity). The uniform tribolelectric charging behavior of the developer mix supplies a uniform amount of toner to magnetic roller and subsequently to the photoconductor drum. Therefore, the print quality thus obtained is similar across various environments and does not change as a function of temperature and/or humidity.

However using toner particles in a developer mix manufactured via an emulsion aggregation usually results in the developer mix having an undesirable variable charge across different temperature and humidity conditions. This is due to the fact that the emulsion aggregation process of making toner is a wet process that involves the use of flocculants such as metal salts, acids, and bases. The emulsion aggregation process also uses surfactants and/or dispersants in resin, pigment and wax emulsions. Insufficient removal of these surfactants or dispersants can have a significant negative impact on the tribocharge of the developer mix because the presence of acid, base or salts can negatively influence the tribocharging nature. For example, the presence of a trivalent salt such as aluminum chloride or aluminum sulfate can significantly lower the triboelectric charging behavior, in particular if it is a negative charging system. Additionally, the presence of salts on toner surface can negatively influence the interaction of the toner with moisture, thereby rendering the system humidity-sensitive.

Accordingly, it is desirous to achieve uniform tribocharge behavior for a developer mix from various toner batches and reproducibility across various manufacturing toner lots as well as across different temperature and humidity conditions. This tribocharge uniformity ultimately leads to uniform print quality throughout the life of the cartridge and not dependent on the varying environmental temperature and conditions.

SUMMARY OF THE INVENTION

The present disclosure is directed at a formulation for a developer mix having tribocharge uniformity across different temperature and humidity conditions. This developer mix having tribocharge uniformity includes a magnetic carrier particle having surface additives on its surface.

DETAILED DESCRIPTION

The present disclosure is directed at a formulation for a developer mix having tribocharge uniformity across different temperature and humidity conditions. This developer mix having tribocharge uniformity includes a magnetic carrier particle having surface additives on its surface. Exemplary surface additives include but are not limited to silica, titania, and alumina. Moreover, these surface additives may be hydrophobized by the use of silanes, silicone oil, or mixtures thereof.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure is directed to a developer mix formulation including a toner resin mixed with a magnetic carrier particle. The magnetic carrier particle used in the developer mix formulation is different from the magnetic carrier particles known in the prior art because it is modified by treating its' surface with a surface additive or a plurality of surface additives before it is mixed with the toner resin particle to form the developer mix. Exemplary surface additives include but are not limited to silica, titania, and alumina. Moreover, these surface additives may be hydrophobized by the use of silanes, silicone oil, or mixtures thereof. This additional step of making the surface additives hydrophobic changes the inherent tribocharge of the surface additives. It may also be noted that the magnetic carrier particle may be treated with different types and amounts of surface additives so as to fine tune the desired tribocharge at various temperatures and humidity conditions.

A developer mix used in DCD printers is typically composed of toner mixed with magnetic carrier particles. The magnetic carrier particle serves two principal functions, namely transporting the toner for development to the photoconductor and imparting a triboelectric charge to the toner. Modern day DCD printers and copiers employ single or multiple magnetic developer rolls or magnetic brushes. Magnetic brushes with stationary magnets and rotating sleeves use magnetic carrier particles made from soft magnetic material and those with rotating magnets and stationary sleeves use hard magnetic materials. Magnetic carrier particles are typically in the range of 20 to 300 μm in size with smaller sizes typically between 30 to 50 μm generally preferred for better print or quality. The small magnetic carrier particle is typically spherical in nature; however, non-spherical carriers have been used. The magnetic material, typically called a carrier core, can be coated with a polymer based composition. The coating serves two principal functions, namely providing the triboelectric couple for charging the toner and preventing the toner from adhering to the carrier which limits the charging of the toner.

Soft magnetic materials used for the carrier core are usually derived from magnetic oxides either in the form of a magnetite or a ferrite. Ferrites for magnetic carriers are mixtures of iron oxide with oxides of zinc, copper, magnesium, or manganese that are combined through a combination of wet and dry processes to form the carrier core with the desired physical, chemical and magnetic properties.

Hard ferrite magnetic carriers tend to be permanent magnets. They exhibit high coercivity and remanence following magnetization. The high coercivity means the materials are very resistant to becoming demagnetized, an essential characteristic for a permanent magnet. They also tend to exhibit better magnetic flux and have high magnetic permeability. In contrast, Soft ferrite carriers have low coercivity and the magnetization can be reversed without dissipating much energy.

The carrier core can be coated using various known processes including powder coating, spray solution coating and fluidized bed processes. The coating material can be a dry polymer in the case of powder coating or a solution or suspension with a water or solvent base. Many types of polymers and polymer blends can be used in the carrier coatings including polystyrene, acrylics, acrylics modified with fluoropolymers, and siloxanes as examples. Various useful commercially available magnetic carrier particles are manufactured by Powdertech, Co. Ltd., Kashiwa City Japan, Dowa Electronics Materials Co. Ltd., Tokyo, Japan, and Issei Co. Ltd., Tokyo, Japan.

To improve the tribocharge performance of a developer mix across different temperature and humidity environments, the inventors have surprisingly discovered that by performing the step of modifying the surface of the magnetic carrier particle with surface additives before the magnetic carrier particle is mixed with the toner resin particles is an effective way to achieve this desired tribocharge uniformity under different temperature and humidity conditions. The carrier is pre-treated with a surface additive such as silica, alumina, titania, or mixtures thereof. These surface additives may incorporate various surface treatments which render the surface additive hydrophobic. Table 1 outlines exemplary surface additives, their respective particle size prior to surface treatment and their respective surface treatment. The list is for illustrative purposes only and is not meant to be exhaustive.

TABLE 1

Example Surface Additives

| Surface Additive | Primary Particle Size (nm) | Surface Treatment on Surface Additive |
|---|---|---|
| Silica S1 | 7 | None (Hydrophilic) |
| Silica S2 | 7 | Hexamethyldisilizane (HMDS) |
| Silica S3 | 40 | Hexamethyldisilizane (HMDS) |
| Silica S4 | 40 | Polydimethilsiloxane (PDMS) |
| Silica S5 | 50 | Polydimethilsiloxane/Hexamethyl-disilizane (PDMS/HMDS) |
| Silica S6 | 70 | Dimethyldiethoxysilane (DMDES) |
| Silica S7 | 70 | Polydimethilsiloxane (PDMS) |
| Silica S8 | 80 | Hexamethyldisilizane (HMDS) |
| Silica S9 | 80 | Polydimethilsiloxane (PDMS) |
| Silica S10 | 100 | Dimethyldiethoxysilane (DMDES) |
| Silica S11 | 12 | Octyltriethoxysilane |
| Alumina A1 | 12 | Octyltriethoxysilane |
| Titania T1 | 40 | Dimethyldiethoxysilane (DMDES) |
| Titania T2 | 60 | None |

In the present emulsion aggregation process, the toner particles are provided by chemical methods as opposed to physical methods such as pulverization. Generally, the toner includes one or more polymer binders, a release agent, a colorant, a borax coupling agent and one or more optional additives such as a charge control agent (CCA). An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used. The ratio of the amount of polymer binder in the toner core to the amount of toner in the shell is between about 20:80 (wt.) and about 80:20 (wt.) including all values and increments therebetween, such as between about 50:50 (wt.) and about 80:20 (wt.), depending on the particular resin(s) used.

The colorant, release agent, and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the release agent dispersion, the colorant dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex (es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binder

As mentioned above, the toners herein include one or more polymer binders. The terms resin and polymer are used interchangeably herein as there is no technical difference between the two. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof.

In other embodiments, the polymer binder(s) include a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, polyvinyl chloride), polyurethanes, polyamides, silicones, epoxy resins, or phenolic resins.

As discussed above, in some embodiments, the toner core may be formed from one polymer binder (or mixture) and the toner shell formed from another. Further, the ratio of the amount of polymer binder in the toner core to the amount of toner in the toner shell may be between about 20:80 (wt.) and about 80:20 (wt.) or more specifically between about 50:50 (wt.) and about 80:20 (wt.) including all values and increments therebetween. The total polymer binder may be provided in the range of about 70% to about 95% by weight of the final toner formulation including all values and increments therebetween.

Borax Coupling Agent

The coupling agent used herein is borax (also known as sodium borate, sodium tetraborate, or disodium tetraborate). As used herein the term coupling agent refers to a chemical compound having the cross-linking ability to bond two or more components together. Typically, coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

It has also been observed that borax surprisingly causes fine particles to collect on larger particles. Borax surprisingly causes the colorant, release agent and resin to collect on the toner core before the shell layer is added, which prevents them from migrating to the toner surface. As a result, borax is particularly suitable as a coupling agent between the core and shell layers of the toner because it collects the residue components of the toner core on the core particle before the shell is added thereby reducing the residual fine particles in the toner. This, in turn, reduces the amount of acid needed in the agglomeration stage and narrows the particle size distribution of the toner.

Borax also serves as a good buffer in the toner formation reaction as a result of the equilibrium formed by its boric acid and conjugate base. The presence of borax makes the reaction more resistant to pH changes and broadens the pH adjusting window of the reaction in comparison with a conventional emulsion aggregation process. The pH adjusting window is crucial in the industrial scale up of the process to control the particle size. With a broader window, the process is easier to control at an industrial scale.

The quantity of the borax coupling agent used herein can be varied. The borax coupling agent may be provided at between about 0.1% and about 5.0% by weight of the total polymer binder in the toner including all values and increments therebetween, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

Release Agent

The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters.

The release agent may therefore include a low molecular weight hydrocarbon based polymer (e.g., Mn≤10,000) having a melting point of less than about 140° C. including all values and increments between about 50° C. and about 140° C. For example, the release agent may have a melting point of about 60° C. to about 135° C., or from about 65° C. to about 100° C., etc. The release agent may be present in the dispersion at an amount of about 5% to about 35% by weight including all values and increments therebetween. For example, the release agent may be present in the dispersion at an amount of about 10% to about 18% by weight. The dispersion of release agent may also contain particles at a size of about 50 nm to about 1 μm including all values and increments therebetween. In addition, the release agent dispersion may be further characterized as having a release agent weight percent divided by dispersant weight percent (RA/D ratio) of about 1:1 to about 30:1. For example, the RA/D ratio may be about 3:1 to about 8:1. The release agent may be provided in the range of about 2% to about 20% by weight of the final toner formulation including all values and increments therebetween.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof. Commercial plasticizers that are known in the art may also be used to adjust the coalescening temperature of the toner formulation.

Optionally, extra particular additives such as various sized silicas made also be added to the surface of the toner particle to improve its' flow. The toner of the present invention may then be treated with a blend of extra particulate agents, including medium silica sized 40 nm-50 nm, large colloidal silica sized equal to or greater than 70 nm and optionally, alumina, small silica, and/or titania. Treatment using the extra particulate agents may occur in one or more steps, wherein the given agents may be added in one or more steps during the blending process.

Medium silica may be understood as silica having a primary particle size in the range of 30 nm to 60 nm, or between 40 nm to 50 nm, prior to any after treatment, including all values and increments therein. Primary particle size may be understood as the largest linear dimension through a particle volume. The medium silica may be present in the toner formulation as an extra particulate agent in the range of 0.1% to 2.0% by weight of the toner composition, including all values and increments in the range of 0.1% to 2.0% by weight. The medium silica may also be treated with surface additives that may impart different hydrophobic characteristics or different charges to the silica. For example, the silica may be treated with hexamethyldisilazane, polydimethylsiloxane (silicone oil), etc. Exemplary silicas may be available from Evonik Corporation under the tradename Aerosil and product numbers RX-50 or RY-50.

Large colloidal silica may be understood as silica having a primary particle size in the range of greater than 70 nm, preferably between 70 nm to 120 nm, prior to any after treatment, including all values and increments therein. Most colloidal silicas are prepared as monodisperse suspensions with particle sizes ranging from approximately 30 nm to 150 nm in diameter. Polydisperse suspensions can also be synthesized and have roughly the same limits in particle size. Smaller particles are difficult to stabilize while particles much greater than 150 nm are subject to sedimentation. Whereas fumed silica tend to form agglomerates or aggregates, colloidal silica are dispersed more uniformly and in most cases dispersed as individual particles and have significantly fewer agglomerates or aggregates.

The large colloidal silica may be present in the toner formulation as an extra particulate agent in the range of 0.1 wt % to 2 wt %, for example in the range of 0.25 wt % to 1 wt % of the toner composition. The large colloidal silica may also be treated with surface additives that may impart different hydrophobic characteristics or different charges to the silica. For example, the large colloidal silica may be treated with hexamethyldisilazane, polydimethylsiloxane, dimethyldichlorosilane, and combinations thereof, wherein the treatment may be present in the range of 1 wt % to 10 wt % of the silica. An example of the large silica may be available from Cabot Corp. under the trade name TGC110, or from Sukgyung AT Inc. under the trade name of SGSO100C.

The alumina ($Al_2O_3$) that may be used herein may have an average primary particle size in the range of 5 nm to 20 nm, including between 8 nm to 16 nm (largest cross-sectional linear dimension). In addition, the alumina may be surface treated with an inorganic/organic compound which may then improve mixing (e.g. compatibility) with organic based toner compositions. For example, the alumina may include an octylsilane coating. The alumina may be present in the range of 0.01% to 1.0% by weight of the toner composition, including all values and increments therein, such as in the range of 0.01% to 0.25%, or 0.05% to 0.10% by weight. An example of the aluminum oxide may be that available from Evonik Corporation under the tradename Aeroxide and product number C 805.

Small silica may be understood as silica ($SiO_2$) having an average primary particle size in the range of 2 nm to 20 nm, or between 5 nm to 15 nm (largest cross-sectional linear dimension) prior to any after treatment, including all values and increments therein. The small silica may be present in the toner formulation as an extra particulate agent in the range of 0.1% to 0.5% by weight, including all values and increments therein. In addition, the small silica may be treated with hexamethyldisilazane. Exemplary small silica may be available from Evonik Corporation under the tradename Aerosil and product number R812.

In addition, titania (titanium-oxygen compounds such as titanium dioxide) may be added to the toner composition as a extra particulate additive. The titania may be present in the formulation in the range of about 0.2% to 1.0% by weight, including all values and increments therein. The titania may include a surface treatment, such as aluminum oxide. The titania particles may have a mean particle length in the range of 1.0 μm to 3.0 μm, such as 1.68 μm and a mean particle diameter in the range of 0.05 μm to 0.2 μm, such as 0.13 μm. An example of titania contemplated herein may include FTL-110 available from ISK USA. The following examples are provided to further illustrate the teachings of the present disclosure, not to limit the scope of the present disclosure.

The following examples are provided to further illustrate the teachings of the present disclosure, not to limit the scope of the present disclosure.

EXAMPLES

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Petrolite, Corp., Westlake, Ohio, USA was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Polyester Resin Emulsion A

A mixed polyester resin having a peak molecular weight of about 9,000, a glass transition temperature (Tg) of about 53° C. to about 58° C., a melt temperature (Tm) of about 110° C., and an acid value of about 15 to about 20 was used. The glass transition temperature is measured by differential scanning calorimetry (DSC), wherein, in this case, the onset of the shift in baseline (heat capacity) thereby indicates that the Tg may occur at about 53° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the mixed polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 10 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

Example Toner A

The Example Polyester Resin Emulsion A was divided into two batches, split 70:30 by weight to form the core and the shell of the toner, respectively. The total polyester content represented about 87.7% of the total toner solids. Accordingly, the first batch contained 61.4% of the total toner solids and the second batch contained 26.3% of the total toner solids. Components were added to a 2.5 liter reactor in the following percentages: the first batch of the Example Polyester Resin Emulsion A having 61.4 parts (polyester by weight), 6.8 parts (pigment by weight) of the Example Cyan Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 40-45° C. Once the particle size reached 4.0 μm (number average), 5% (wt.) borax solution (30 g of solution having 1.5 g of borax) was added. The borax content represented about 0.5% by weight of the total toner solids. After the addition of borax, the second batch of the Example Polyester Resin Emulsion A was added, which contained 26.3 parts (polyester by weight). The mixture was stirred for about 5 minutes and the pH was monitored. Once the particle size reached 5.5 μm (number average), 4% NaOH was added to raise the pH to about 5.95 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.65 μm and a number average particle size of 5.49 μm. Fines (<2 μm) were present at 0.11% (by number) and the toner possessed a circularity of 0.978.

Toner A was placed in a CYCLOMIX along with about 0.5% by weight of small silica such as Aerosil R812 from Evonik Corporation, 1.0% of medium silica RY50 from Evonik Corporation and 2.0% of large silica such as SGSO100CDM8 from Sukgyung AT Inc. The CYCLOMIX was run for about 90 seconds. Subsequently the finished toner was evaluated.

Example Magnetic Carrier Particle

Illustrative examples of magnetic carrier particles that can be selected for mixing with the toner prepared as outlined above include those carriers that are capable of triboelectrically obtaining a charge of opposite polarity to that of the toner particles. Examples of such carrier particles include iron, iron alloys, steel, nickel, iron ferrites, including iron ferrites that incorporate magnesium, manganese, magnetites, strontium, copper, zinc and the like. The selected carrier particles can be used with or without a coating. The coating is generally made from acrylic and methacrylic polymers such as methyl methacrylate, acrylic and methacrylic copolymers with fluoropolymers or with monoalkyl or dialkylamines, polyolefins, polystyrenes, such as polyvinylidene fluoride resins, terpolymers of styrene, methyl methacrylate, and a silane such as triethoxy silane, tetraflouroethylenes and other known coatings in the art. Useful magnetic carriers to be used in the present invention have a average volume particle size between 25 μm and 40 μm, a saturation magnetization between 50 and 120 emu/g ($A \cdot m^2/kg$), apparent bulk density between 2.0-2.7 $g/cm^3$, and true specific gravity between 4.5-5.3. Unless otherwise stated, all developer mixes discussed are formulated and tested herein comprise a mixture of Toner A described above mixed with a magnetic carrier particle using a ferrite carrier with an acrylic coating having an average size particle between 35 μm and 40 μm and a saturation magnetization between 65 and 72 emu/g ($A \cdot m^2/kg$). This particular magnetic carrier particle is hereinafter referred to as 'Control Magnetic Carrier'.

Preparation of Comparative Developer Mix 1

28 grams of Toner A was mixed with 322 grams of Control Magnetic Carrier (toner concentration 8% by weight and control magnetic carrier concentration 92% by weight) in a Turbula mixer for about 10 minutes to form Comparative Developer Mix 1. Initial tribocharge of Comparative Developer Mix 1 was measured in a q/m Epping meter based on a known toner mass. The Epping toner charge value reported for all toners tested herein may be determined by combining the toner and magnetic carrier beads which tribocharge each other. Accordingly, a known amount of toner and carrier beads may be mixed and shaken together, and a pre-weighed sample of such toner/bead combination placed in a Faraday cage with screens on both ends. The Epping meter consists of this cage and directs air in one end of the cage. Charged toner passes with the air stream out of the other end of the cage (i.e., the screen retains the carrier beads). Weights before and after toner removal may provide toner mass; an electrometer may measure the toner charge (i.e., carrier charge of equal and opposite sign corresponding to the toner removed). It should therefore be appreciated that toner charge may serve as a basis for evaluating toner conveyance in an electrophotographic system.

Preparation of Developer Mix 1a 322 grams of Control Magnetic Carrier and 1.61 grams of small (7 nm) silica (S2) were weighed and added to a V-blender, and mixed for about 25 minutes to form Magnetic Carrier 1a. Following this pretreatment step, 28 grams of Toner A was mixed with 322 grams of Magnetic Carrier 1a (toner concentration 8% by weight and magnetic carrier 1a concentration 92% by weight) in a Turbula mixer for about 10 minutes to form Developer Mix 1a. Initial tribocharge of the Developer Mix 1a was measured in a q/m Epping meter based on a known toner mass.

Preparation of Developer Mix 1b 322 grams of Control Magnetic Carrier and 3.22 grams of medium (40 nm) silica (S3) were weighed and added to a V-blender, and mixed for about 25 minutes to form Magnetic Carrier 1b. Following this pretreatment step, 28 grams of Toner A, was mixed with 322 grams of Magnetic Carrier 1b (toner concentration 8% by weight and magnetic carrier 1b concentration 92% by weight) in a Turbula mixer for about 10 minutes to form Developer Mix 1b. Initial tribocharge of Developer Mix 1b was measured in a q/m Epping meter based on a known toner mass.

Preparation of Developer Mix 1c 322 grams of Control Magnetic Carrier and 4.83 grams of large (100 nm) silica (S10) were weighed and added to a V-blender, and mixed for about 25 minutes to produce Magnetic Carrier 1c. Following this pretreatment step, Toner A was mixed with the Magnetic Carrier 1c (toner concentration 8% by weight and magnetic carrier 1c concentration 92% by weight) in a Turbula mixer for about 10 minutes to form Developer Mix 1c. Initial tribocharge of Developer Mix 1c was measured in a q/m Epping meter based on a known toner mass.

TABLE 2

Effect of Pre-Treated Carrier on Tribocharge of Developer Mix 1

| Developer Mix | Surface Additive on Magnetic Carrier | Surface Treatment on Surface Additive | Developer Mix Appearance | Initial Tribocharge (μC/g) (at 8% toner composition) |
|---|---|---|---|---|
| Comparative 1 | None | None | Good | −97 |
| 1a | 0.5% 7 nm (S2) | HMDS | Speckled | −70 |
| 1b | 1% 40 nm (S3) | HMDS | Highly Speckled | −62 |
| 1c | 1.5% 100 nm (S10) | DMDES | Highly Speckled | −46 |

Table 2 shows how to achieve a desired tribocharge modification to the developer mix. This is done by pretreating the magnetic carrier used to formulate the developer mix with a small (7 nm), medium (40 nm), or large silica (100 nm) having various surface treatments as identified therein. The initial tribocharge of the Comparative Developer Mix 1 is decreased each time by treating the magnetic carrier particle comprising the steps of adding a surface additive on the magnetic carrier before the magnetic carrier is mixed with the toner resin to form the developer mix. By treating the magnetic carrier particle with 1.5% of 100 nm silica surface treated with DMDES, the charge of the developer mix decreases from about −97 μC/g to about −46 μC/g. By adding the surface additives to the surface of the carrier particle surface, the same lowering in tribocharge can be achieved without having to modify the surface additives on the toner.

Developer Mixes 1a, 1b, and 1c showed speckles or white particles, signifying the presence of some unincorporated surface additives. As these speckles could impact the overall print performance, minimizing or eliminating the speckles is preferred. Therefore an optional screening step may be performed to eliminate these unwanted speckles. The optional screening step follows the blending of the magnetic carrier particle and the chosen surface additive (prior to the mixing of the pretreated carrier and the toner to form the developer mix). The screen used in this process may be chosen in a manner to achieve maximum throughput or yield. For example, a screen of about 55 μm may be used if the magnetic carrier particle is about 35 μm in size. Optionally, the screening step may be carried out following the developer mix preparation, i.e. mixing of the surface treated magnetic carrier and a toner.

To further understand and probe the impact of the type and size of different surface additives might have on the initial tribocharge of a developer mix and the tribocharge of the developer mix across different temperature and humidity environments, different additives were used in the pre-treatment step done to the magnetic carrier. For environment testing, Toner A was soaked for four hours at certain temperature and humidity environments including hot/wet (78° F./80% RH), ambient (72° F./40% RH), and cold/dry (60° F./8% RH) prior to its mixing with different pre-treated magnetic carriers to make the different developer mixes described herein below.

Preparation of Comparative Developer Mix 2

1.6 grams of Toner A was soaked as discussed above was mixed with 18.4 grams of Control Magnetic Carrier (toner concentration 8% by weight and control magnetic carrier concentration 92% by weight) in a Turbula mixer for about 10 minutes. Initial tribocharge of Comparative Developer Mix 2 was measured in a q/m Epping meter based on a known toner mass.

Preparation of Developer Mix 2a 500 grams of Control Magnetic Carrier and 1 gram of 7 nm silica (S1) were weighed and added to a V-blender, and mixed for about 25 minutes to produce Magnetic Carrier 2a. Following this pretreatment step, 1.6 grams of Toner A was mixed with 18.4 grams of Magnetic Carrier 2a (toner concentration 8% by weight and magnetic carrier 2a concentration 92% by weight) in a Turbula mixer for about 10 minutes to produce Developer Mix 2a. Initial tribocharge of Developer Mix 2a was measured in a q/m Epping meter based on a known toner mass.

Preparation of Developer Mix 2b 500 grams of Control Magnetic Carrier and 1 gram of 7 nm silica (S2) were weighed and added to a V-blender, and mixed for about 25 minutes to produce Magnetic Carrier 2b. Following this pretreatment step, 1.6 grams of Toner A was mixed with 18.4 grams of Magnetic Carrier 2b (toner concentration 8% by weight and magnetic carrier 2b concentration 92% by weight) in a Turbula mixer for about 10 minutes to form Developer Mix 2b. Initial tribocharge of Developer Mix 2b was measured in a q/m Epping meter based on a known toner mass.

Preparation of Developer Mix 2c 500 grams of Control Magnetic Carrier and 2.5 grams of 70 nm silica (S7) were weighed and added to a V-blender, and mixed for about 25 minutes to produce Magnetic Carrier 2c. Following this pretreatment step, 1.6 grams of Toner A was mixed 18.4 grams of Magnetic Carrier 2c (toner concentration 8% by weight and magnetic carrier 2c concentration 92% by weight) in a Turbula mixer for about 10 minutes to form Developer Mix 2c. Initial tribocharge of Developer Mix 2c was measured in a q/m Epping meter based on a known toner mass.

Preparation of Developer Mix 2d 500 grams of Control Magnetic Carrier magnetic carrier and 2.5 grams of 100 nm silica (S10) were weighed and added to a V-blender, and mixed for about 25 minutes to produce Magnetic Carrier 2d. Following this pretreatment step, 1.6 grams of Toner A was mixed with 18.4 grams of Magnetic Carrier 2d (toner concentration 8% by weight and magnetic carrier 2d concentration 92% by weight) in a Turbula mixer for about 10 minutes to form Developer Mix 2d. Initial tribocharge Developer Mix 2d was measured in a q/m Epping meter based on a known toner mass.

TABLE 3

Effect of Pre-Treated Carrier on Tribocharge of Developer Mix Having Different Temperature and Humidity Environments

| Developer Mix | Surface Additive on Magnetic Carrier | Surface Treatment On Surface Additive | Developer Mix Appearance | Initial Tribocharge (μC/g) (Toner soaked at 60° F./8% RH, 4 hrs) Cold/Dry | Initial Tribocharge (μC/g) (Toner soaked at 72° F./40% RH, 4 hrs) Ambient | Initial Tribocharge (μC/g) (Toner soaked at 78° F./80% RH, 4 hrs) Hot/Humid | Charge Delta (μC/g) (Max − Min) |
|---|---|---|---|---|---|---|---|
| Comparative 2 | None | None | Good | −92 | −71.6 | −54.3 | 37.7 |
| 2a | 0.2% 7 nm (S1) | None | Good | −59.5 | −42.9 | −39.4 | 20.1 |
| 2b | 0.2% 7 nm (S2) | HMDS | Good | −77.7 | −50.9 | −42.3 | 35.4 |
| 2c | 0.5% 70 nm (S7) | PDMS | Good | −46.5 | −35.7 | −26.2 | 20.3 |
| 2d | 0.5% 100 nm (S10) | DMDES | Good | −50.6 | −37.9 | −30 | 20.6 |

All of the pre-treated carriers shown in Table 3 were screened through a mesh screen prior its addition into an 8% toner composition developer mix. The screened pre-treated magnetic carriers did not show speckles. Developer Mixes 2a and 2c using pretreated magnetic carriers exhibit a lower initial tribocharge compared to the Comparative Developer Mix 2 having an untreated magnetic carrier.

Comparative Developer Mix 2 shows about a 38 μC/g charge delta difference between a cold/dry (60° F./8% RH) and hot/humid (78° F./80% RH) environment. However Developer Mixes 2a, 2b, 2c, and 2d using a pretreated magnetic carrier have a much lower charge delta. This small charge delta results in a desired uniform charging behavior across varying temperature and humidity conditions such as Cold/Dry and Hot/Humid. It may also be noted that the hydrophilic nature of S1 results in a lower charge than its hydrophobized version S2. The charge delta across environments also appears to be driven by initial tribocharge at ambient conditions, lower the tribocharge showing less charge delta across environments.

The effectiveness of different silica and alumina sized 12 nm or less having different surface treatments thereon as surface additives on the magnetic were investigated. For environment testing, Toner A was soaked for four hours at certain temperature and humidity conditions including hot/wet: 78° F./80% RH, ambient: 72° F./40% RH, and cold/dry: 60° F./8% RH prior to mixing Toner A with different pre-treated magnetic carriers to make the following developer mixes.

Preparation of Comparative Developer Mix 3

Toner A (1.6 grams) soaked as discussed above was mixed with 18.4 grams of Control Magnetic Carrier (toner concentration 8% by weight and control magnetic carrier concentration 92% by weight) in a Turbula mixer for about 10 minutes. Initial tribocharge of the Comparative Developer Mix 3 was measured in a q/m Epping meter based on a known toner mass.

Preparation of Develop Mix 3a

Control Magnetic Carrier (18.4 grams) and 0.09 grams of small (7 nm) silica (S2) were weighed and added to a V-blender, and mixed for about 25 minutes to form Magnetic Carrier 3a. Following this pretreatment step, 1.6 grams of Toner A was mixed with 18.4 grams of Magnetic Carrier 3a (toner concentration 8% by weight and magnetic carrier 3a concentration 92% by weight) in a Turbula mixer for about 10 minutes to form Developer Mix 3a. Initial tribocharge of the Developer Mix 3a was measured in a q/m Epping meter based on a known toner mass.

Preparation of Develop Mix 3b

Control Magnetic Carrier (18.4 grams) and 0.09 grams of small (7 nm) silica (S1) were weighed and added to a V-blender, and mixed for about 25 minutes to form Magnetic Carrier 3b. Following this pretreatment step, 1.6 grams of Toner A was mixed with 18.4 grams of Magnetic Carrier 3b (toner concentration 8% by weight and magnetic carrier 3b concentration 92% by weight) in a Turbula mixer for about 10 minutes to form Developer Mix 3b. Initial tribocharge of the Developer Mix 3b was measured in a q/m Epping meter based on a known toner mass.

Preparation of Develop Mix 3c

Control Magnetic Carrier (18.4 grams) and 0.09 grams of small (12 nm) silica (S11) were weighed and added to a V-blender, and mixed for about 25 minutes to form Magnetic Carrier 3c. Following this pretreatment step, 1.6 grams of Toner A was mixed with 18.4 grams of Magnetic Carrier 3c (toner concentration 8% by weight and weight and magnetic carrier 3c concentration 92% by weight) in a Turbula mixer for about 10 minutes to form Developer Mix 3c. Initial tribocharge of the Developer Mix 3c was measured in a q/m Epping meter based on a known toner mass.

Preparation of Develop Mix 3d

Control Magnetic Carrier (18.4 grams) and 0.09 grams of small (12 nm) alumina (A1) were weighed and added to a V-blender, and mixed for about 25 minutes to form Magnetic Carrier 3d. Following this pretreatment step, Toner A (1.6 grams) was mixed with 18.4 grams of Magnetic Carrier 3d (toner concentration 8% by weight and magnetic carrier 3d concentration 92% by weight) in a Turbula mixer for about 10 minutes to form Developer Mix 3d. Initial tribocharge of the Developer Mix 3d was measured in a q/m Epping meter based on a known toner mass.

TABLE 4

Effect of Inherent Tribocharge of the Surface Additive on A Magnetic Carrier

| Developer Mix | Surface Additive on Magnetic Carrier | Surface Additive Type/Surface Treatment on Surface Additive | Initial Tribocharge (μC/g) (Toner soaked for 4 hrs at 72° F./44% RH Ambient) | Initial Tribocharge (μC/g) (Toner soaked for 4 hrs at 78° F./80% RH) Hot/Humid | Charge Delta(μC/g) Max − Min |
|---|---|---|---|---|---|
| Comparative 3 | None | None | −75.8 | −54.3 | 21.5 |
| 3a | 0.5% 7 nm(S2) | Silica/Silane | −88.3 | −39.4 | 48.9 |
| 3b | 0.5% 7 nm (S1) | Silica/None | −54.9 | −42.3 | 12.6 |
| 3c | 0.5% 12 nm (S11) | Silica/Silicone Oil | −42.8 | −26.2 | 16.6 |
| 3d | 0.5% 12 nm(A1) | Alumina/Octyl-triethoxysilane | 30 | 20.9 | 9.1 |

Table 4 shows the impact on the inherent tribocharge associated with the surface additive to the tribocharge of a developer mix. The inherent tribocharge of an additive is dependent on the type of surface additive (for example: Silica, Alumina) and also the type of surface treatment on the surface additive (hydrophobized using a silane, silicone oil etc.). The only difference between S1 and S2 is S2 is silica that has been surface treated with a silane or hexamethyldislazane (HMDS). The initial tribocharge of Developer Mix 3a at ambient temperature is significantly higher than the initial tribocharge of Developer Mix 3b at ambient temperature. However, the charge delta of Developer Mix 3a is smaller than the charge delta of Developer Mix 3b. These test results demonstrates that the desirable small charge delta is obtained by treating the surface of the magnetic carrier particle with a surface additive that has been made hydrophobic by surface treatment. Developer Mix 3d using alumina (Al) that has been surface-treated with octyltriethoxysilane lowers the initial tribocharge of the developer mix from −75 μC/g to about −21 μC/g. Additionally Developer Mix 3d show a desired small charge delta—ultimately leading to a developer mix that can perform in varying temperature and humidity environments.

Evaluation of the effectiveness of using magnetic carrier particles in a developer mix that have been pretreated with titanium dioxide or 'titania' was also investigated. A surface-treated titania about 40 nm in size was selected for evaluation. The material T1 (surface-treated with 8% dimethyldiethoxysilane) was used at various levels ranging from about 0.05% to about 0.25% by weight of the magnetic carrier.

Preparation of Comparative Developer Mix 4

Toner A (1.6 grams, soaked at Cold/Dry, Ambient and Hot/Humid environments for 4 hours) was mixed with 18.4 grams of Control Magnetic Carrier (toner concentration 8% by weight and control magnetic carrier concentration 92% by weight) in a Turbula mixer for about 10 minutes to make Comparative Developer Mix 4. Initial tribocharge of the Comparative Developer Mix 4 was measured in a q/m Epping meter based on a known toner mass.

Preparation of Developer Mix 4a

Control Magnetic Carrier (500 grams) and 0.25 grams of 40 nm of titania (T1) (0.05% by weight of the Control Magnetic Carrier) were weighed and added to a V-blender, and mixed for about 25 minutes to form Magnetic Carrier 4a. Following this pretreatment step, Toner A (1.6 grams, soaked at Cold/Dry, Ambient and Hot/Humid environments for 4 hours) was mixed with 18.4 grams of Magnetic Carrier 4a (toner concentration 8% by weight and magnetic carrier 4a concentration 92% by weight) in a Turbula mixer for about 10 minutes to form Developer Mix 4a. Initial tribocharge of the Developer Mix 4a was measured in a q/m Epping meter based on a known toner mass.

Preparation of developer Mix 4b

Control Magnetic Carrier (500 grams) and 0.5 grams of 40 nm of titania (T1) (0.1% by weight of the Control Magnetic Carrier) were weighed and added to a V-blender, and mixed for about 25 minutes to form Magnetic Carrier 4b. Following this pretreatment step, Toner A (1.6 grams, soaked at Cold/Dry, Ambient and Hot/Humid environments for 4 hours) was mixed with 18.4 grams of Magnetic Carrier 4b (toner concentration 8% by weight and magnetic carrier 4b concentration 92% by weight) in a Turbula mixer for about 10 minutes to form Developer Mix 4b. Initial tribocharge of the Developer Mix 4b was measured in a q/m Epping meter based on a known toner mass.

Preparation of Developer Mix 4c

Control Magnetic Carrier (500 grams) and 1 gram of 40 nm of titania (T1) (0.2% by weight of the Control Magnetic Carrier) were weighed and added to a V-blender, and mixed for about 25 minutes to form Magnetic Carrier 4c. Following this pretreatment step, Toner A (1.6 grams, soaked at Cold/Dry, Ambient and Hot/Humid environments for 4 hours) was mixed with 18.4 grams of Magnetic Carrier 4c (toner concentration 8% by weight and magnetic carrier 4c concentration 92% by weight) in a Turbula mixer for about 10 minutes to form Developer Mix 4b. Initial tribocharge of the Developer Mix 4c was measured in a q/m Epping meter based on a known toner mass.

Preparation of Developer Mix 4d

Control Magnetic Carrier (500 grams) and 1.25 grams of 40 nm of titania (T1) (0.25% by weight of the Control Magnetic Carrier) were weighed and added to a V-blender, and mixed for about 25 minutes to form Magnetic Carrier 4d. Following this pretreatment step, Toner A (1.6 grams, soaked at Cold/Dry, Ambient and Hot/Humid environments for 4 hours) was mixed with 18.4 grams of Magnetic Carrier 4d (toner concentration 8% by weight and magnetic carrier 4d concentration 92% by weight) in a Turbula mixer for about 10 minutes to form Developer Mix 4d. Initial tribocharge of the Developer Mix 4d was measured in a q/m Epping meter based on a known toner mass.

TABLE 5

Evaluation of 40 nm Titania as a Pre-treatment Surface Additive on A Magnetic Carrier

| Developer Mix | Surface Additive on Magnetic Carrier | Surface Treatment on Surface Additive | Initial Tribocharge (μC/g) (Toner soaked at 60° F./8% RH, 4 hrs) Cold/Dry | Initial Tribocharge (μC/g) (Toner soaked at 72° F./40% RH, 4 hrs) Ambient | Initial Tribocharge (μC/g) (Toner soaked at 78° F./80% RH, 4 hrs) Hot/Humid | Charge Delta (μC/g) (Max − Min) |
|---|---|---|---|---|---|---|
| Comparative 4 | None | None | −92 | −70 | −49 | 43 |
| 4a | 0.05% (T1) | DMDES | −65 | −62 | −47 | 18 |
| 4b | 0.1% (T1) | DMDES | −50 | −45 | −38 | 12 |
| 4c | 0.2% (T1) | DMDES | −44 | −38 | −33 | 11 |
| 4d | 0.25% (T1) | DMDES | −32 | −29 | −28 | 4 |

Table 5 describes the impact on the initial tribocharge and charge stability across different temperature and humidity environments of developer mixes using a magnetic carrier pre-treated with different levels of concentration of 40 nm titania that is surface treated with dimethyldiethoxysilane (DMDES). It is apparent from the results in Table 4 that the initial charge of the developer mix can be lowered each time the concentration level of the titania is increased. The initial charge is desirably lowered from about −70 μC/g to about −29 μC/g in ambient conditions at 0.25% concentration of T1 by weight of the magnetic carrier. Even when the concentration level for T1 is as small as 0.05% (Example 4a) the stability is significantly better than the Comparative Example 4.

Further study was carried out to evaluate surface additives that have a primary particle size greater than 20 nm. Table 5 illustrates the results of this study.

Preparation of Comparative Developer Mix 5

1.6 grams of Toner A (soaked at Cold/Dry, Ambient and Hot/Humid environments for 4 hours) was mixed with 18.4 grams of Control Magnetic Carrier (toner concentration 8% by weight and control magnetic carrier concentration 92% by weight) in a Turbula mixer for about 10 minutes to make Comparative Developer Mix 5. Initial tribocharge of the Comparative Developer Mix 5 was measured in a q/m Epping meter based on a known toner mass.

Preparation of Developer Mix 5a

Control Magnetic Carrier (500 grams) and 1 gram of 40 nm of silica (S4) (0.5% by weight of the Control Magnetic Carrier) were weighed and added to a V-blender, and mixed for about 25 minutes to form Magnetic Carrier 5a. Following this pretreatment step, Toner A (1.6 grams, soaked at Cold/Dry, Ambient and Hot/Humid environments for 4 hours) was mixed with 18.4 grams of Magnetic Carrier 5a (toner concentration 8% by weight and magnetic carrier 5a concentration 92% by weight) in a Turbula mixer for about 10 minutes to form Developer Mix 5a. Initial tribocharge of the Developer Mix 5a was measured in a q/m Epping meter based on a known toner mass.

Preparation of Developer Mix 5b

Control Magnetic Carrier (500 grams) and 1.25 grams of 50 nm of silica (S5) (0.25% by weight of the Control Magnetic Carrier) were weighed and added to a V-blender, and mixed for about 25 minutes to form Magnetic Carrier 5b. Following this pretreatment step, Toner A (1.6 grams, soaked at Cold/Dry, Ambient and Hot/Humid environments for 4 hours) was mixed with 18.4 grams of Magnetic Carrier 5b (toner concentration 8% by weight and magnetic carrier 5b concentration 92% by weight) in a Turbula mixer for about 10 minutes to form Developer Mix 5b. Initial tribocharge of the Developer Mix 5b was measured in a q/m Epping meter based on a known toner mass.

Preparation of Developer Mix 5c

Control Magnetic Carrier (500 grams) and 1.75 grams of 50 nm of silica (S5) (1.25% by weight of the Control Magnetic Carrier) were weighed and added to a V-blender, and mixed for about 25 minutes to form Magnetic Carrier 5c. Following this pretreatment step, Toner A (1.6 grams, soaked at Cold/Dry, Ambient and Hot/Humid environments for 4 hours) was mixed with 18.4 grams of Magnetic Carrier 5c (toner concentration 8% by weight and magnetic carrier 5c concentration 92% by weight) in a Turbula mixer for about 10 minutes to form Developer Mix 5c. Initial tribocharge of the Developer Mix 5c was measured in a q/m Epping meter based on a known toner mass.

Preparation of Developer Mix 5d

Control Magnetic Carrier (500 grams) and 0.5 grams of 70 nm of silica (S7) (0.1% by weight of the Control Magnetic Carrier) were weighed and added to a V-blender, and mixed for about 25 minutes to form Magnetic Carrier 5d. Following this pretreatment step, Toner A (1.6 grams, soaked at Cold/Dry, Ambient and Hot/Humid environments for 4 hours) was mixed with 18.4 grams of Magnetic Carrier 5d (toner concentration 8% by weight and magnetic carrier 5d concentration 92% by weight) in a Turbula mixer for about 10 minutes to form Developer Mix 5d. Initial tribocharge of the Developer Mix 5d was measured in a q/m Epping meter based on a known toner mass.

Preparation of Developer Mix 5e

Control Magnetic Carrier (500 grams) and 1 gram of 70 nm of silica (S6) (0.2% by weight of the Control Magnetic Carrier) were weighed and added to a V-blender, and mixed for about 25 minutes to form Magnetic Carrier 5e. Following this pretreatment step, Toner A (1.6 grams, soaked at Cold/Dry, Ambient and Hot/Humid environments for 4 hours) was mixed with 18.4 grams of Magnetic Carrier 5e (toner concentration 8% by weight and magnetic carrier 5e concentration 92% by weight) in a Turbula mixer for about 10 minutes to form Developer Mix 5e. Initial tribocharge of the Developer Mix 5e was measured in a q/m Epping meter based on a known toner mass.

Preparation of Developer Mix 5f

Control Magnetic Carrier (500 grams) and 2.5 grams of 70 nm of silica (S7) (0.5% by weight of the Control Magnetic Carrier) were weighed and added to a V-blender, and mixed for about 25 minutes to form Magnetic Carrier 5f. Following this pretreatment step, Toner A (1.6 grams, soaked at Cold/Dry, Ambient and Hot/Humid environments for 4 hours) was mixed with 18.4 grams of Magnetic Carrier 5f (toner concentration 8% by weight and magnetic carrier 5f concentration 92% by weight) in a Turbula mixer for about 10 minutes to form Developer Mix 5f. Initial tribocharge of the Developer Mix 5f was measured in a q/m Epping meter based on a known toner mass.

Preparation of Developer Mix 5g

Control Magnetic Carrier (500 grams) and 2.5 grams of 80 nm of silica (S8) (0.5% by weight of the Control Magnetic Carrier) were weighed and added to a V-blender, and mixed for about 25 minutes to form Magnetic Carrier 5g. Following this pretreatment step, Toner A (1.6 grams, soaked at Cold/Dry, Ambient and Hot/Humid environments for 4 hours) was mixed with 18.4 grams of Magnetic Carrier 5g (toner concentration 8% by weight and magnetic carrier 5g concentration 92% by weight) in a Turbula mixer for about 10 minutes to form Developer Mix 5g. Initial tribocharge of the Developer Mix 5g was measured in a q/m Epping meter based on a known toner mass.

Preparation of Developer Mix 5h

Control Magnetic Carrier (500 grams) and 2.5 grams of 80 nm of silica (S9) (0.5% by weight of the Control Magnetic Carrier) were weighed and added to a V-blender, and mixed for about 25 minutes to form Magnetic Carrier 5h. Following this pretreatment step, Toner A (1.6 grams, soaked at Cold/Dry, Ambient and Hot/Humid environments for 4 hours) was mixed with 18.4 grams of Magnetic Carrier 5h (toner concentration 8% by weight and magnetic carrier 5h concentration 92% by weight) in a Turbula mixer for about 10 minutes to form Developer Mix 5h. Initial tribocharge of the Developer Mix 5h was measured in a q/m Epping meter based on a known toner mass.

TABLE 6

Impact of Different Sized Silica Particles to Initial Tribocharge and Charge Across Different Environments of Developer Mix

| Developer Mix | Surface Additive On Magnetic Carrier | Surface Treatment on Surface Additive | Initial Tribocharge (μC/g) (Toner soaked at 60° F./8% RH, 4 hrs) Cold/Dry | Initial Tribocharge (μC/g) (Toner soaked at 72° F./40% RH, 4 hrs) Ambient | Initial Tribocharge (μC/g) (Toner soaked at 78° F./80% RH, 4 hrs) Hot/Humid | Charge Delta (μC/g) (Max − Min) |
|---|---|---|---|---|---|---|
| Comparative 5 | None | None | −92 | −70 | −49 | 43 |
| 5a | 0.5% 40 nm (S4) | PDMS | −86 | −67 | −45 | 41 |
| 5b | 0.25% 50 nm (S5) | PDMS/HMDS | −86 | −67 | −42 | 44 |
| 5c | 1.25% 50 nm (S5) | PDMS/HMDS | −61 | −53 | −36 | 25 |
| 5d | 0.1% 70 nm (S7) | PDMS | −86 | −62 | −47 | 39 |

TABLE 6-continued

Impact of Different Sized Silica Particles to Initial Tribocharge and Charge Across Different Environments of Developer Mix

| Developer Mix | Surface Additive On Magnetic Carrier | Surface Treatment on Surface Additive | Initial Tribocharge (μC/g) (Toner soaked at 60° F./8% RH, 4 hrs) Cold/Dry | Initial Tribocharge (μC/g) (Toner soaked at 72° F./40% RH, 4 hrs) Ambient | Initial Tribocharge (μC/g) (Toner soaked at 78° F./80% RH, 4 hrs) Hot/Humid | Charge Delta (μC/g) (Max − Min) |
|---|---|---|---|---|---|---|
| 5e | 0.2% 70 nm (S6) | DMDES | −83 | −57 | −44 | 39 |
| 5f | 0.5% 70 nm (S7) | PDMS | −46 | −35 | −26 | 20 |
| 5g | 0.5% 80 nm (S8) | HMDS | −47 | −34 | −27 | 20 |
| 5h | 0.5% 80 nm (S9) | PDMS | −76 | −69 | −43 | 33 |

Table 6 shows trends in charge behavior by varying the size of the silica being used for surface treatment of the magnetic carrier. In general, higher levels of the medium primary particle or surface additives are required. When silica particles are previously surface-treated with silicone oil (PDMS), such as in Developer Mix 5a and 5h, there is a slight improvement in charge stability across environments. However, Developer Mix 5g shows that silica treated with silane (HMDS) lowers the initial charge at ambient conditions (72° F./40% RH) compared to Developer Mix 5. Also, Developer Mix 5g shows better charge stability across environments. Further, for the large sized silica, better charge stability across environments is seen when the level of silica is greater than 0.2% by weight of carrier.

Hence, it is apparent from the above examples that an effective developer mix formulation that can control or tailoring the its initial tribocharge at different temperature and humidity environments, as well as to ensure uniformity of the tribocharge across these varying temperature and humidity conditions, can be achieved when the developer mix includes a magnetic carrier particle wherein the surface of the magnetic carrier particle contains a surface additive or a plurality of surface additives.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A developer mix formulation to be used in an electrophotographic imaging device comprising:

toner particles, magnetic carrier particles having a polymer coating on their outer surface; and one or more extra particular additives selected from the group consisting of silica, titania and alumina or combinations thereof surface treated on the outer surface of the polymer coated magnetic carrier particles.

2. The developer mix formulation of claim 1, wherein the polymer coating is acrylic.

3. The developer mix formulation of claim 1 wherein the polymer coated magnetic carrier particles have a ferrite core.

4. The developer mix formulation of claim 1 wherein the polymer coated magnetic carrier particles have an average particle size between 30 μm to about 50 μm and a saturation magnetization of 50 and 120 emu/g ($A \cdot m^2/kg$).

5. The developer mix formulation of claim 1, wherein the extra particulate additives are surface treated with a hydrophobizing agent selected from a group consisting of hexamethyldisilazane, polydimethylsiloxane, dimethyldiethoxysiloxane, octyltriethoxysilane and combinations thereof.

6. The developer mix formulation of claim 1, wherein the extra particulate additives have an average primary particle size in the range of about 7 nm to about 100 nm.

7. The developer mix formulation of claim 1, wherein the extra particulate additives are present in the range of about 0.05% to about 1.0% by weight of the polymer coated magnetic carrier particles.

8. The developer mix formulation of claim 1, wherein the extra particulate additives are present in the range of about 0.05% to about 0.15% by weight of the polymer coated magnetic carrier particles.

9. The developer mix formulation of claim 1 wherein the extra particulate additive is titania.

10. The developer mix formulation of claim 1 wherein the extra particulate additive is silica.

* * * * *